US007964043B2

(12) United States Patent
Petzold et al.

(10) Patent No.: US 7,964,043 B2
(45) **Date of Patent: *Jun. 21, 2011**

(54) METHOD FOR PRODUCING NANOCRYSTALLINE MAGNET CORES, AND DEVICE FOR CARRYING OUT SAID METHOD

(75) Inventors: Jörg Petzold, Bruchköbel (DE); Volker Kleespies, Jossgrund (DE); Hans-Rainer Hilzinger, Langenselbold (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/486,528

(22) Filed: Jun. 17, 2009

(65) Prior Publication Data

US 2010/0018610 A1 Jan. 28, 2010

Related U.S. Application Data

(63) Continuation of application No. 10/472,065, filed as application No. PCT/EP02/07755 on Jul. 11, 2002, now Pat. No. 7,563,331.

(30) Foreign Application Priority Data

Jul. 13, 2001 (DE) ..... 101 34 056

(51) Int. Cl.
*H01F 1/14* (2006.01)

(52) U.S. Cl. ..... 148/121; 148/304

(58) Field of Classification Search ..... None
See application file for complete search history.

(56) References Cited

U.S. PATENT DOCUMENTS

| | | | |
|---|---|---|---|
| 2,225,730 | A | 12/1940 | Armstrong |
| 2,926,008 | A | 2/1960 | Barnett et al. |
| 2,960,744 | A | 11/1960 | Blank |
| 3,255,512 | A | 6/1966 | Lochner et al. |
| 3,337,373 | A | 8/1967 | Foster et al. |
| 3,401,035 | A | 9/1968 | Moskowitz et al. |
| 3,502,462 | A | 3/1970 | Dabkowski et al. |
| 3,624,568 | A | 11/1971 | Olsen et al. |
| 3,634,072 | A | 1/1972 | Ackermann et al. |
| 3,718,776 | A | 2/1973 | Bate et al. |

(Continued)

FOREIGN PATENT DOCUMENTS

CH 668331 12/1988

(Continued)

OTHER PUBLICATIONS

Sundar, R.S. et al.; Soft Magnetic FeCo alloys; alloy development, processing, and properties; International Materials Reviews, vol. 50, No. 3, pp. 157-192, 2005.

(Continued)

*Primary Examiner* — John P Sheehan
(74) *Attorney, Agent, or Firm* — Buchanan, Ingersoll & Rooney PC

(57) ABSTRACT

The invention relates to a method and to a device for carrying out a manufacturing process in which all magnet cores to be produced are first continuously crystallized. Depending on whether the required hysteresis loops should be round, flat or rectangular, the magnet cores are either immediately finished, that is enclosed in housings, conditioned to a rectangular hysteresis loop in a direct-axis magnetic field or to a flat hysteresis loop in a magnetic cross-field and then finished.

14 Claims, 6 Drawing Sheets

U.S. PATENT DOCUMENTS 3,977,919 A 8/1976 Foster et al.
4,076,525 A 2/1978 Little et al.
4,076,861 A 2/1978 Furukawa et al.
4,120,704 A 10/1978 Anderson
4,160,066 A 7/1979 Szumachowski et al.
4,201,837 A 5/1980 Lupinski
4,324,597 A 4/1982 Kamino et al.
4,601,765 A 7/1986 Soileau et al.
4,812,181 A 3/1989 Hilzinger et al.
4,891,079 A 1/1990 Nakajima et al.
4,923,533 A 5/1990 Shigeta et al.
4,950,550 A 8/1990 Radeloff et al.
4,969,963 A 11/1990 Honkura et al.
4,994,122 A 2/1991 DeBold et al.
5,069,731 A 12/1991 Yoshizawa et al.
5,091,024 A 2/1992 DeBold et al.
5,200,002 A 4/1993 Hilzinger
5,202,088 A 4/1993 Genma et al.
5,261,152 A 11/1993 Simozaki et al.
5,268,044 A 12/1993 Hemphill et al.
5,501,747 A 3/1996 Masteller et al.
5,522,946 A 6/1996 Tomita et al.
5,534,081 A 7/1996 Takagi et al.
5,594,397 A 1/1997 Uchikoba et al.
5,611,871 A 3/1997 Yoshizawa et al.
5,703,559 A 12/1997 Emmerich et al.
5,714,017 A 2/1998 Tornida et al.
5,725,686 A 3/1998 Yoshizawa et al.
5,741,373 A 4/1998 Suzuki et al.
5,741,374 A 4/1998 Li
5,769,974 A 6/1998 Masteller et al.
5,804,282 A 9/1998 Watanabe et al.
5,817,191 A 10/1998 Emmerich et al.
5,911,840 A 6/1999 Couderchon et al.
5,914,088 A 6/1999 Rao et al.
5,922,143 A 7/1999 Verin et al.
5,976,274 A 11/1999 Inoue et al.
6,106,376 A 8/2000 Rybak et al.
6,118,365 A 9/2000 Petzold et al.
6,171,408 B1 1/2001 Herzer et al.
6,181,509 B1 1/2001 Canlas et al.
6,270,592 B1 8/2001 Nakajima et al.
6,373,368 B1 4/2002 Shikama et al.
6,416,879 B1 * 7/2002 Sakamoto et al. ..... 428/606
6,425,960 B1 * 7/2002 Yoshizawa et al. ..... 148/300
6,462,456 B1 10/2002 DeCristofaro et al.
6,487,770 B1 12/2002 Bernauer et al.
6,507,262 B1 1/2003 Otte et al.
6,563,411 B1 5/2003 Otte et al.
6,580,348 B1 6/2003 Hundt et al.
6,588,093 B1 7/2003 Emmerich et al.
6,616,125 B2 9/2003 Brown et al.
6,668,444 B2 * 12/2003 Ngo et al. ..... 29/606
6,685,882 B2 2/2004 Deevi et al.
6,710,692 B2 3/2004 Kato et al.
6,749,767 B2 6/2004 Mitani et al.
6,750,723 B2 6/2004 Yoshida et al.
6,942,741 B2 9/2005 Shimao et al.
6,946,097 B2 9/2005 Deevi et al.
6,962,144 B2 11/2005 Chretien et al.
7,128,790 B2 10/2006 Waeckerle et al.
7,442,263 B2 10/2008 Günther et al.
7,532,099 B2 5/2009 Brunner
7,563,331 B2 7/2009 Petzold et al.
2002/0062885 A1 5/2002 Li
2002/0158540 A1 10/2002 Lindquist et al.
2003/0020579 A1 * 1/2003 Ngo et al. ..... 336/5
2003/0034091 A1 2/2003 Shimao et al.
2004/0025841 A1 2/2004 Chretien et al.
2004/0027220 A1 2/2004 Günther et al.
2004/0089377 A1 5/2004 Deevi et al.
2004/0099347 A1 5/2004 Waeckerle et al.
2004/0112468 A1 6/2004 Petzold et al.
2004/0183643 A1 9/2004 Brunner
2005/0017587 A1 1/2005 Koenig
2005/0268994 A1 12/2005 Gerster et al.
2007/0176025 A1 8/2007 Gerster
2008/0042505 A1 2/2008 Gerster et al.
2008/0099106 A1 5/2008 Pieper et al.
2008/0136570 A1 6/2008 Gerster
2009/0039994 A1 2/2009 Pieper et al.
2009/0145522 A9 6/2009 Pieper et al.
2009/0184790 A1 7/2009 Pieper et al.

FOREIGN PATENT DOCUMENTS

CN 1185012 A 6/1998
DE 502063 7/1930
DE 694374 7/1940
DE 1740491 12/1956
DE 1564643 1/1970
DE 2816173 10/1979
DE 3324729 1/1984
DE 3237183 4/1984
DE 3427716 11/1985
DE 3542257 6/1987
DE 4030791 A1 8/1991
DE 4210748 C1 12/1993
DE 4442420 A1 5/1996
DE 4444482 A1 6/1996
DE 19608891 A1 9/1997
DE 19635257 3/1998
DE 19802349 A1 7/1998
DE 69810551 T2 3/1999
DE 19844132 4/1999
DE 19818198 10/1999
DE 19860691 A1 3/2000
DE 19908374 A1 9/2000
DE 19928764 A1 1/2001
DE 69611610 7/2001
DE 10024824 11/2001
DE 10031923 A1 1/2002
DE 69903202 6/2003
DE 10211511 10/2003
DE 10320350 9/2004
EP 0216457 A1 4/1987
EP 0240755 10/1987
EP 0299498 1/1989
EP 0392204 A2 10/1990
EP 0429022 5/1991
EP 0271657 5/1992
EP 0 502 397 A2 9/1992
EP 0509936 A2 10/1992
EP 0635853 1/1995
EP 0637038 2/1995
EP 0435680 B1 4/1995
EP 0715320 A1 6/1996
EP 0455113 B1 6/1997
EP 0824755 B1 2/1998
EP 0899 753 B1 3/1999
EP 1 371 434 B1 12/2003
EP 1475450 A1 11/2004
EP 1475450 A1 11/2004
EP 1503486 2/2005
GB 833446 4/1960
GB 1369844 10/1974
JP 51092097 A 2/1975
JP 54006808 A 6/1977
JP 59058813 A 4/1984
JP 59177902 10/1984
JP 61058450 3/1986
JP 61-253348 11/1986
JP 62093342 A 4/1987
JP 63-115313 A 5/1988
JP 1247557 A 3/1989
JP 2-111003 A 4/1990
JP 2-301544 A 12/1990
JP 03-019307 1/1991
JP 03-146615 6/1991
JP 4-365305 A 12/1992
JP 05283238 10/1993
JP 05-299232 11/1993
JP 06-033199 2/1994
JP 06-224023 8/1994
JP 08-246109 9/1996
JP 63021807 1/1998
JP 10-092623 4/1998
JP 10-097913 4/1998

| | | | |
|---|---|---|---|
| JP | 2000-182845 | | 6/2000 |
| JP | 2000-277357 | A | 10/2000 |
| JP | 2001-068324 | | 3/2001 |
| JP | 2002-294408 | A | 3/2001 |
| JP | 2006-193779 | | 7/2006 |
| JP | 2006-322057 | | 11/2006 |
| JP | 2007-113148 | | 5/2007 |
| SU | 338550 | | 5/1972 |
| SU | 1062298 | A1 | 7/1982 |
| WO | WO 96/00449 | | 1/1996 |
| WO | WO 96/19001 | | 6/1996 |
| WO | WO 00/28556 | | 5/2000 |
| WO | WO 00/30132 | | 5/2000 |
| WO | WO 01/00895 | A1 | 1/2001 |
| WO | WO 01/86665 | A1 | 11/2001 |
| WO | WO 02/055749 | | 7/2002 |
| WO | WO 03/003385 | | 1/2003 |
| WO | WO 03/007316 | A2 | 1/2003 |
| WO | WO 03/088281 | A1 | 10/2003 |
| WO | WO 2007/088513 | | 8/2007 |

OTHER PUBLICATIONS

Stahlschlüssel 1958. Marbach: Verlag Stahlschlüssel Wegst GmbH, 1998, Version 2.0, ISBN 3-922599-15-X, Window "Analyse-Suche".
Major and Orrock, "High Saturation Ternary Cobalt-Iron Based Alloys," IEEE Transactions on Magnetics, vol. 24, No. 2, Mar. 1988, pp. 1856-1858.
D. Grätzer et al., "Transduktor in Schaltnetzteilen", VAC trade literature TB-410-1 Vacummschmelze GmbH, Hanau, Germany, May 1998.
E. Wolfarth: "Ferromagnetic Materials vol. 2," p. 73 (1980).
J. Wünning: "Die Wärmebehandlung in der Fertigungslinie mit einem neuartigen Rollenherdofen," HTM Härterei—Technische Mitteilungen 45 Nov./Dec. 1990 No. 6, pp. 325-329 XP 163038.
Examination Report dated Sep. 24, 2009 for European Publication No. 02 745 429.7-2208.
Liu Junxin et Yuqin Qiu: "Heat Treating Method of Nanocrystalline Current Transformer Core" (English Translation and Certificate of Translation dated Nov. 23, 2009).
H. Reinboth, "Technologie and Anwendung magnetischer Werkstoffe," Veb Verlag Technik, p. 230 (1969) (English Translation and Certificate of Translation dated Nov. 23, 2009).
Examination Report dated Feb. 26, 2003 for German Patent Publication No. 101 34 056.7-33 (English Translation and Certificate of Translation dated Nov. 23, 2009).
German Patent Publication No. 694374 (English Translation and Certificate of Translation dated Nov. 23, 2009).
Chinese Patent Publication No. CN1185012A (English Translation and Certificate of Translation dated Nov. 23, 2009).
Non-Final Office Action dated Sep. 29, 2008 for U.S. Appl. No. 11/343,558.
Non-Final Office Action dated Apr. 6, 2009 for U.S. Appl. No. 11/343,558.
Non-Final Office Action dated Jun. 11, 2009 for U.S. Appl. No. 11/663,271.
Non-Final Office Action dated Sep. 22, 2009 for U.S. Appl. No. 11/663,271.
Final Office Action dated Oct. 30, 2009 for U.S. Appl. No. 11/343,558.
R. McCurrie, "Ferromagnetic Materials Structure and Properties," Academic Press, pp. 77-78 (1994).
Taub A. I., "Effect of the heating rate used during stress relief annealing on the magnetic properties of amorphous alloys", Journal of Applied Physics, American Institute of Physics, New York, US vol. 55, No. 6, part 2A, Mar. 15, 1984, pp. 1775-1777.
ASM Materials Engineering Dictionary, Edited by J.R. Davis, Davis & Associates, 1992, p. 2002.
Abstract of Japanese Patent Publication No. 2000277357, Oct. 6, 2000.
Abstract of Japanese Patent Publication No. 59058813, Apr. 4, 1984.
Liu Junxin Yuqin Qiu: "Heat Treating Method of Nanocrystalline Current Transformer Core".
First Office Action mailed Jan. 7, 2005 issued by the Chinese Patent Office for Chinese Patent Application No. 02809188.4.
Second Office Action mailed Jul. 8, 2005 issued by the Chinese Patent Office for Chinese Patent Application No. 02809188.4.
Examination Report dated Sep. 24, 2009 for European Publication No. 02 745 429.7-2208 (English Translation and Certificate of Translation dated Dec. 30, 2010).
Examination Report dated Feb. 26, 2003 for German Patent Publication No. 101 34 056.7-33 (English Translation and Certificate of Translation dated Nov. 23, 2009).
Notification of Reasons for Refusal dated Feb. 2, 2010 for Japanese Patent Publication No. 2002-527519 and English Translation of the same.
Heczko, O. et al., "Magnetic Properties of Compacted Alloy Fe 73.5Cu7Nb3Si13.5B9 in Amorphous and Nanocrystalline State", IEEE Transaction Magazine, vol. 29, No. 6, 1993, 2670 English Abstract.
Office Action dated Apr. 22, 2010 for German Patent Application No. 10 2009 038 730.7-24 and English Translation of the same.
Non-Final Office Action dated Jun. 11, 2009 for U.S. Appl. No. 11/663,271.
Non-Final Office Action dated Sep. 22, 2009 for U.S. Appl. No. 11/663,271.
Final Office Action dated Oct. 30, 2009 for U.S. Appl. No. 11/343,558.
Non-Final Office Action dated Apr. 1, 2010 for U.S. Appl. No. 11/343,558.
Final Office Action dated Oct. 15, 2010 for U.S. Appl. No. 11/343,558.
Non-Final Office Action dated Aug. 31, 2010 for U.S. Appl. No. 11/878,856.
Restriction Requirement dated Nov. 4, 2009 for U.S. Appl. No. 11/878,856.
Non-Final Office Action dated Mar. 22, 2010 for U.S. Appl. No. 11/878,856.
Restriction Requirement dated Sep. 22, 2010 for U.S. Appl. No. 12/219,615.
Restriction Requirement dated Sep. 19, 2008 for U.S. Appl. No. 11/897,875.
Restriction Requirement dated Dec. 15, 2008 for U.S. Appl. No. 11/897,875.
Non-Final Office Action dated Feb. 23, 2009 for U.S. Appl. No. 11/897,875.
Non-Final Office Action dated Feb. 2, 2010 for U.S. Appl. No. 11/897,875.
Final Office Action dated Jun. 9, 2010 for U.S. Appl. No. 11/897,875.
Non-Final Office Action dated Sep. 9, 2010 for U.S. Appl. No. 11/897,875.
H. Reinboth, "Technologie und Anwendung magnetischer Werkstoffe," Veb Verlag Technik, p. 230 (1969) (English Translation and Certificate of Translation dated Nov. 23, 2009).
E. Wolfarth: "Ferromagnetic Materials vol. 2," —Soft Magnetic Metallic Materials—p. 73 (1980).
Sundar, R.S. et al.; Soft Magnetic FeCo alloys; alloy development, processing, and properties; International Materials Reviews, 2005, vol. 50, No. 3, pp. 157-192.
Liu Junxin et al "Heat Treating Method of Nanocrystalline Current Transformer Core," Amorphous and Nanocrystalline Alloy Engineering Technology Center, Central Iron and Steel Research Institute, Beijing, [TB383]:TG[139*8]8 Document Identification Code: A No. 1005 [8192] (2001)02-0036-03 (English Translation and Certificate of Translation dated Nov. 23, 2009).
English Translation of International Preliminary Report on Patentability and Written Opinion mailed Feb. 7, 2008 for International Patent Application No. PCT/DE2006/001241.
Carpenter Specialty Alloys; Alloy Data, Chrome Core 8 & 8-FM Alloys and Chrome Core 12 & 12-FM Alloys; Carpenter Technology Corporation; Electronic Alloys; 12 pgs.

* cited by examiner

METHOD FOR PRODUCING NANOCRYSTALLINE MAGNET CORES, AND DEVICE FOR CARRYING OUT SAID METHOD

CROSS REFERENCE TO RELATED APPLICATIONS

This application is a continuation of U.S. application Ser. No. 10/472,065, filed Feb. 3, 2004, now U.S. Pat. No. 7,563,331 which was the U.S. National Phase of Application PCT/EP02/07755, filed Jul. 11, 2002, which claims priority to German Patent Application No. 101 34 056.7 filed on Jul. 13, 2001, the contents of which are hereby incorporated by reference.

BACKGROUND

1. Field

The invention relates to a process for the production of nanocrystalline magnet cores as well as devices for carrying out such a process.

2. Description of Related Art

Nanocrystalline iron-based soft magnetic alloys have been known for a long time and have been described, for example, in EP 0 271 657 B1. The iron-based soft magnetic alloys described there have in general a composition with the formula:

$$(Fe_{1-a}M_a)_{100-x-y-z-\alpha}Cu_xSi_yB_zM'_\alpha$$

where M is cobalt and/or nickel, M' is at least one of the elements niobium, tungsten, tantalum, zirconium, hafnium, titanium, and molybdenum, the indices a, x, y, z, and α each satisfy the condition $0 \leqq a \leqq 0.5$; $0.1 \leqq x \leqq 3.0$, $0 \leqq y \leqq 30.0$, $0 \leqq z \leqq 25.0$, $5 \leqq y+z \leqq 30.0$, and $0.1 < \alpha \leqq 30$.

Furthermore, the iron-based soft magnetic alloys can also have a composition with the general formula $$(Fe_1\text{-}a\ M_a)_{100-x-y-z-\alpha-\beta-\gamma}Cu_xSi_yB_zM'_\alpha M''_\beta X_\gamma$$

where M is cobalt and/or nickel, M' is at least one of the elements niobium, tungsten, tantalum, zirconium, hafnium, titanium, and molybdenum, M" is at least one of the elements vanadium, chromium, manganese, aluminum, an element of the platinum group, scandium, yttrium, a rare earth, gold, zinc, tin, and/or rhenium, and X is at least one of the elements carbon, germanium, phosphorus, gallium, antimony, indium, beryllium, and arsenic and where a, x, y, z, α, β and γ each satisfy the condition $0 \leqq a \leqq 0.5$, $0.1 \leqq x \leqq 3.0$, $0 \leqq y \leqq 30.0$, $0 \leqq z \leqq 25.0$, $5 \leqq y+z \leqq 30.0$, $0.1 \leqq \alpha \leqq 30.0$, $\beta \leqq 10.0$, and $\gamma \leqq 10.0$.

In both alloy systems at least 50% of the alloy structure is occupied by fine-crystalline particles with an average particle size of 100 nm or less. These soft magnetic nanocrystalline alloys are to an increasing extent used as magnet cores in inductors for the most various applications in electrical engineering. For example, summation current transformers for alternating current-sensitive and also pulse current-sensitive ground fault circuit breakers, chokes and transformers for switched power supplies, current-compensated chokes, filter chokes, or transductors made of strip-wound cores which have been produced from strips made of the nanocrystalline strips described above are known. This follows, for example, from EP 0 299 498 B1. Furthermore, the use of such annular strip-wound cores also for filter sets in telecommunications is known, for example, as interface transceivers in ISDN or also DSL applications.

The nanocrystalline alloys coming into consideration can, for example, be produced economically by means of the so-called quick-hardening technology (for example, by means of melt-spinning or planar-flow casting). Therein an alloy melt is first prepared in which an initially amorphous alloy is subsequently produced by quick quenching from the melted state. The rates of cooling required for the alloy systems coming into consideration above are around $10^6$ K/sec. This is achieved with the aid of the melt spin process in which the melt is injected through a narrow nozzle onto a rapidly rotating cooling roller and in so doing hardened into a thin strip. This process makes possible the continuous production of thin strips and foils in a single operational step directly from the melt at a rate of 10 to 50 m/sec, where strip thicknesses of 20 to 50 μm and strip widths up to ca. several cm. are possible.

The initially amorphous strip produced by means of this quick-hardening technology is then wound to form a geometrically highly variable magnet core, which can be oval, rectangular, or round. The central step in achieving good soft magnetic properties is the "nanocrystallization" of the up to this point amorphous alloy strips. These alloy strips still have, from the soft magnetic point of view, poor properties since they have a relatively high magnetostriction $|\lambda_s|$ of ca. $25\times10^{-6}$. In carrying out a heat treatment for crystallization adapted to the alloy an ultra-fine structure then arises, that is, an alloy structure arises in which at least 50% of the alloy structure is occupied by cubically spatially centered FeSi crystallites. These crystallites are imbedded in an amorphous residual phase of metals and metalloids. The reasons, from the point of view of solid state physics, for the arising of the fine-crystalline structure and the drastic improvement of the soft magnetic properties thus appearing is described, for example, in G. Herzer, IEEE Transactions on Magnetics, 25 (1989), Pages 3327 ff. Thereafter good soft magnetic properties such as a high permeability or low hysteresis losses through averaging out of the crystal anisotropy $K_u$ of the randomly oriented nanocrystalline "structure" arise.

According to the state of the art known from EP 0 271 657 B1 or 0 299498 B1 the amorphous strips are first wound on special winding machines as free from tension as possible to form annular strip-wound cores. For this, the amorphous strip is first wound to form a round annular strip-wound core and, if required, brought into a non-round form by means of suitable forming tools. Through the use of suitable winding elements however, forms can also be achieved directly with winding of the amorphous strips to form annular strip-wound cores which are different from the round form.

Thereafter the annular strip cores, wound free of tension, are, according to the state of the art, subjected to a heat treatment for crystallization which serves to achieve the nanocrystalline structure. Therein the annular strip-wound cores are stacked one over the other and run into such an oven. It has been shown that a decisive disadvantage of this process lies in the fact that by weak magnetic stray fields, such as, for example, the magnetic field of the earth, a positional dependence of the magnetic values is induced in the magnet core stack. While at the edges of the stack for example, there are high permeability values with an intrinsically limited high remanence ratio of more than 60%, the magnetic values in the area of the middle of the stack are characterized by, more or less pronounced, flat hysteresis loops with low values with regard to permeability and remanence.

This is, for example, represented in FIG. 1. FIG. 1*a* shows the distribution of the permeability at a frequency of 50 Herz as a function of the serial number of the cores within an annealing stack. FIG. 1*b* shows the remanence ratio $B_r/B_m$ as a function of the serial number of the cores within an annealing stack. As can be seen from FIGS. 1*a* and 1*b*, the distribution curve for the magnetic values of an annealing production lot is broad and continuous. The distribution curve drops off monotonically at high values. The precise specific curve depends there on the alloy, the magnet core geometry, and naturally the height of the stack.

In the case of the nanocrystalline alloy structures in question the onset of the nanocrystalline structure typically occurs at temperatures of $T_a$–450° C. to 620° C., where the necessary hold times can lie between a few minutes and ca. 12 hours. In particular, it follows from U.S. Pat. No. 5,911,840 that in the case of nanocrystalline magnet cores with a round BH loop a maximal permeability of $\mu_{max}$=760,000 is reached when a stationary temperature plateau, with a duration of 0.1 to 10 hours below the temperature required for the crystallization of 250° C. to 480° C., is used for the relaxation of the magnet cores. This increases the duration of the heat treatment and reduces its economy.

SUMMARY

The methods and apparatus disclosed herein are based on the discovery that the magnetostatically related formations of parabolas shown in FIGS. 1*a* and 1*b* in the stack annealing of annular strip-wound cores in retort ovens are of a magnetostatic nature and are to be traced back to the location-dependence of the demagnetization factor of a cylinder. Furthermore, it was determined that the exothermic heat of the crystallization process increasing with the core weight can only be released to the environment of the annealing stack incompletely and thus can lead to a clear worsening of the permeability values. It is noted that the nanocrystallization itself is obviously an exothermic physical process. This phenomenon has already been described in JP 03 146 615 A2. The consequence of this insufficient drain of the heat of crystallization is a local overheating of the annular strip-wound cores within the stack which can lead to low permeabilities and to higher remanences. Accordingly, the permeabilities and the remanences of cores in the center of the annealing stack are lower than the permeabilities and the remanences of annular strip-wound cores at the outer edge of the annealing stack. Previously one got around this problem, to the extent that one recognized it at all, by, e.g. as in U.S. Pat. No. 5,911,840, by applying heat, in an uneconomical manner, very slowly in the range of the onset of nanocrystallization, that is, ca. 450° C. Typical heating rates lay in this case between 0.1 and 0.2 K/min, due to which running through the range up to the temperature of 490° C. alone could take up to 7 hours. This method of processing was very uneconomical.

Disclosed herein are embodiments of a new process for the production of annular strip-wound cores in which the problem stated initially of dispersion in the form of a parabola and other, in particular exothermically related, worsenings of magnetic indices can be avoided and which works particularly economically.

Disclosed herein is a process for the production of annular strip-wound cores of the type stated initially, in which process the finally wound amorphous annular strip-wound cores are heat-treated unstacked in passing to form nanocrystalline annular strip-wound cores.

Thus, in one embodiment is provided a process for the production of magnetic cores containing an iron-based soft magnetic alloy wherein at least 50% of the alloy structure is occupied by fine-crystalline particles with an average particle size of 100 nm or less with the following steps:

a) preparation of an alloy melt;

b) production of an amorphous alloy strip from the alloy melt by means of quick-hardening technology;

c) winding of the amorphous strip to form amorphous magnet cores;

d) heat treatment of the unstacked amorphous magnet cores in passing to form nanocrystalline magnetic cores.

In another embodiment is provided an oven for carrying out the process described above, having:

a) an oven housing which has at least one annealing zone and one heating zone;

b) means for assembling the annealing zone with unstacked amorphous magnet cores;

c) means for conveying the unstacked amorphous magnet cores through the annealing zone and d) means for withdrawing the unstacked heat-treated nanocrystalline magnet cores from the annealing zone.

DETAILED DESCRIPTION OF SPECIFIC EMBODIMENTS

Figure 1A:
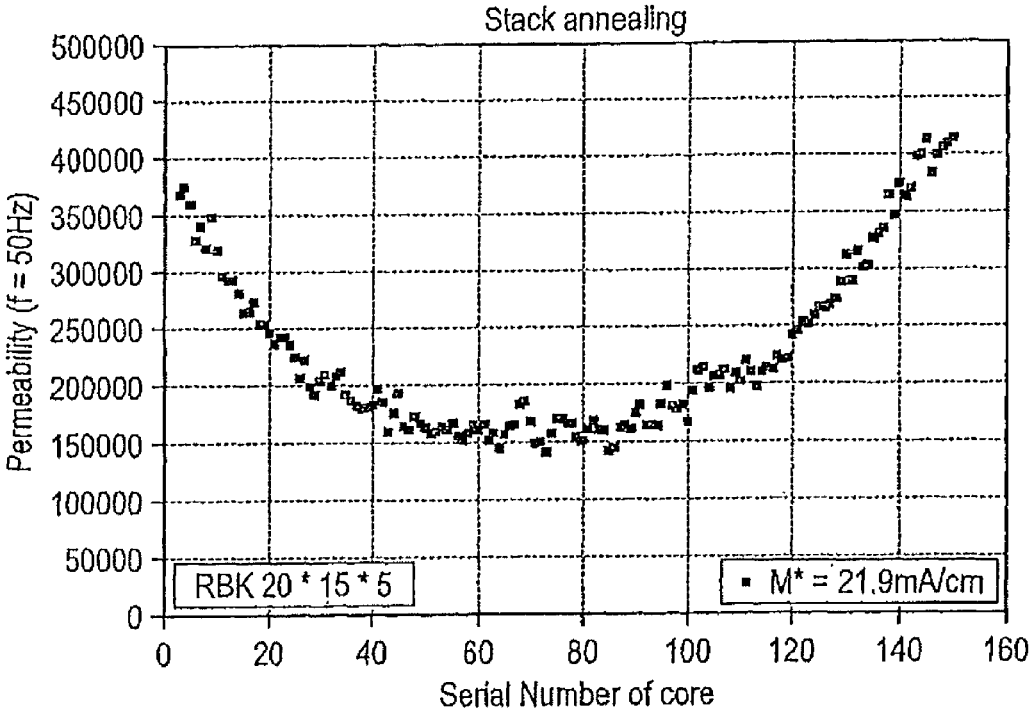
FIG. 1A PRIOR ART
FIG. 1*a* is a graph showing the distribution of magnetic permeability at a frequency of 50 Hz as a function of the number of the cores arranged in series within an annealing stack.
Figure 1B:
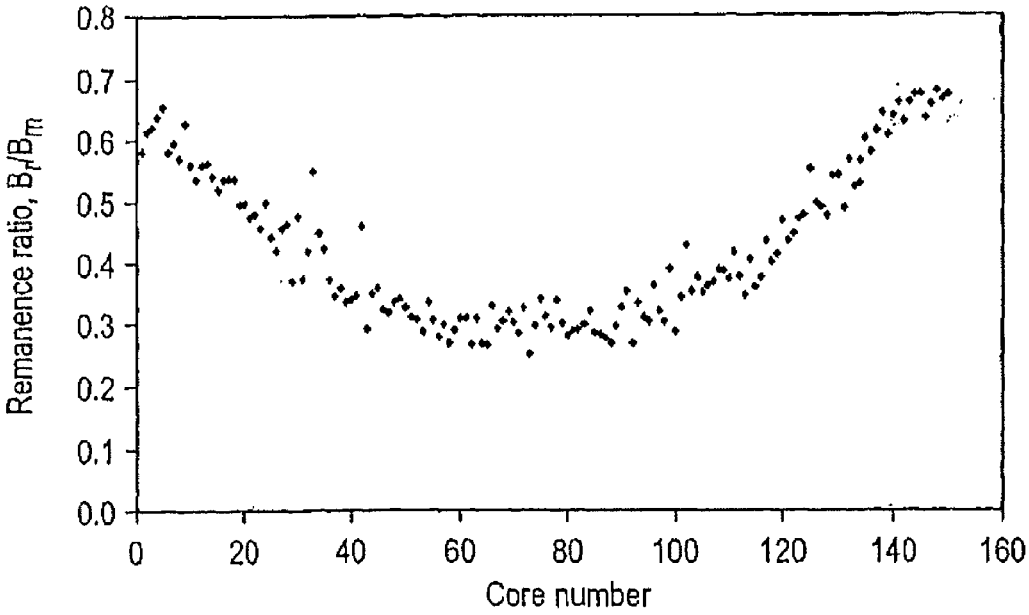
FIG. 1B PRIOR ART
FIG. 1*b* is a graph showing the remanence ratio $B_r/B_m$ as a function of the number of the cores arranged in series within an annealing stack.

Through the singling out of the annular strip-wound cores an identical magnetostatic condition for each individual annular strip-wound core is brought about. The consequence of this magnetostatic crystallization condition identical for each individual annular strip-wound core is the elimination of the "parabola effect" shown in FIGS. 1*a* and 1*b* and thus a restriction of the dispersion to alloy-specific, geometrical, and/or thermal causes.

Preferably the heat treatment of the unstacked amorphous annular strip-wound cores is carried out on heat sinks which have a high thermal capacity and a high thermal conductivity, which also is known for JP 03 146 615 A2. Therein a metal or a metallic alloy in particular comes into consideration as material for the heat sinks. In particular, the metals copper, silver, and thermally conductive steel have proven themselves particularly suitable.

It is however also possible the carry out the heat treatment on a heat sink of ceramics. Furthermore, an embodiment of the process and apparatus disclosed herein is also conceivable in which the amorphous annular strip-wound cores to be treated with heat are mounted in mold bed of ceramic powder or metallic powder, preferably copper powder.

Magnesium dioxide, aluminum oxide, and aluminum nitride have proven themselves particularly suitable as ceramic materials for a solid ceramic plate or for a ceramic powder.

The heat treatment for the crystallization is performed in a temperature range of ca. 450° C. to ca. 620° C., where the heat treatment runs through a temperature window of 450° C. to ca. 500° C. and in so doing is run through at a heating rate of 0.1 K/min to ca. 20 K/min.

The method disclosed herein is preferably carried out with an oven, where the oven has an oven housing which has at least one annealing zone and one heating zone, means for assembling the annealing zone with unstacked amorphous annular strip-wound cores, means for conveying the unstacked amorphous annular strip-wound cores through the annealing zone, and means for withdrawing the unstacked heat-treated nanocrystalline magnet cores from the annealing zone.

Preferably the annealing zone of such an oven is pressurized with a protective gas.

In a first form of embodiment disclosed herein, the oven housing has the structure of a tower oven in which the annealing zone runs vertically. The means for conveying the unstacked amorphous annular strip-wound cores through the vertically running annealing zone are in this case preferably a vertically running conveyor belt.

The vertically running conveyor belt has in this case holding surfaces standing perpendicular to the surface of the conveyor belt and made of a material with high heat capacity, that is, either of the metals described initially or the ceramics described initially, which have a high heat capacity and high thermal conductivity. The annular strip-wound cores lie on the holding surfaces in this case.

The vertically running annealing zone is in this case preferably subdivided into several separate heating zones which are provided with separate heating control systems.

In an alternative form of embodiment of the oven described herein, it has the structure of a tower oven in which the annealing zone runs horizontally. In this case the horizontally running annealing zone is once again subdivided into several separate heating zones which are provided with separate heating control systems.

As means for the conveyance of unstacked amorphous annular strip-wound cores through the horizontally running annealing zone, at least one, but preferably several, holding plates rotating about the axis of the tower oven are provided.

The holding plates once again consist entirely or partially of a material with high heat capacity and high thermal conductivity on which the magnet cores lie. In this case metallic plates come into consideration in particular which consist of the metals stated initially, that is, copper, silver, and thermally conductive steel.

In a third form of embodiment of the oven described herein, it has an oven housing which has the structure of a horizontal continuous annealing oven in which the annealing zone one again runs horizontally. This form of embodiment is particularly preferred because such an oven is relatively simple to produce.

In this case, as means for conveying the unstacked amorphous annular strip-wound cores through the horizontally running annealing zone, a conveyor belt is provided, where the conveyor belt is preferably once again provided with holding surfaces which consist of a material with high heat capacity and high thermal conductivity on which the annular strip-wound cores lie. In this case the metallic and/or ceramic materials discussed initially once again come into consideration.

Here too the horizontally running annealing zone once again is typically subdivided into several separate heating zones which are provided with separate heating control systems.

In another embodiment disclosed herein, the magnetic cross field treatment required for the generation of the flat hysteresis loops can also be generated directly and simultaneously in passing. For this, at least one part of the passage channel encircled by the oven housing is guided between the two pole shoes of a magnetic yoke so that the passing magnet cores are energized in the axial direction with a homogeneous magnetic field whereby a uniaxial anisotropy transverse to the direction of the wound strip is formed in them. The field strength of the yoke in this case must be so high that the magnet cores are saturated, at least partially, in the axial direction during the heat treatment.

The greater the percentage of the oven channel over which the yoke is laid, the flatter and more linear the hysteresis loops are in this case.

For all three alternative developments of the oven described herein, the separate heating zones have a first heating zone, a crystallization zone, a second heating zone, and a ripening zone.

The embodiments disclosed herein are illustrated by way of example in the following with the aid of the drawings.

In particular, for the production of so-called round hysteresis loops, annealing processes are needed which permit the initiation and ripening of an ultrafine nanocrystalline structure under conditions which are as field-free and thermally exact as possible. As mentioned initially, according to the state of the art the annealing is normally carried out in so-called retort ovens in which the magnet cores are run in stacked one over the other.

The decisive disadvantage of this process is that due to weak stray fields, such as, for example, the magnetic field of the earth or similar stray fields, a positional dependence of the magnetic values is induced in the magnet core stack. This can be called the antenna effect. While at the edges of the stack for example, there are actually round loops with high permeability values with an intrinsically limited high remanence ratio of more than 60%, in the area of the middle of the stack there are more or less pronounced, flat hysteresis loops with low values with regard to permeability and remanence. This was shown initially in FIGS. 1*a* and 1*b*.

Accordingly, the distribution curve of the magnetic characteristic values for a production lot is broad, continuous, and drops off monotonically at high values. As mentioned initially the precise curve depends on the soft magnetic alloy used in the particular case, the geometry of the magnet core, and the stack height.

Along with the magnetostatically related parabola formation, stack annealing in retort ovens has the further disadvantage that with increasing core weight the exothermic heat of the crystallization process can only be released to the environment incompletely. The consequence is a local overheating of the stacked magnet cores which can lead to low permeabilities and to higher coercive field strengths. To get around this problem heat was applied very slowly in the range of the onset of crystallization, that is, ca. 450° C., which is uneconomical. Typical heating rates lay in this case between 0.1 and 0.2 K/min, due to which running through the range up to the temperature of 490° C. alone could take up to 7 hours.

The single economically realizable, large-scale industrial alternative to stack annealing in retort ovens lies in a continuous annealing according to the present invention. Through the singling out of the magnet cores by the continuous processing, identical magnetostatic conditions for each individual magnet core are provided. The consequence is the elimination of the parabola effect described above which limits the dispersion to alloy-specific, core-technological, and thermal causes.

Figure 2:
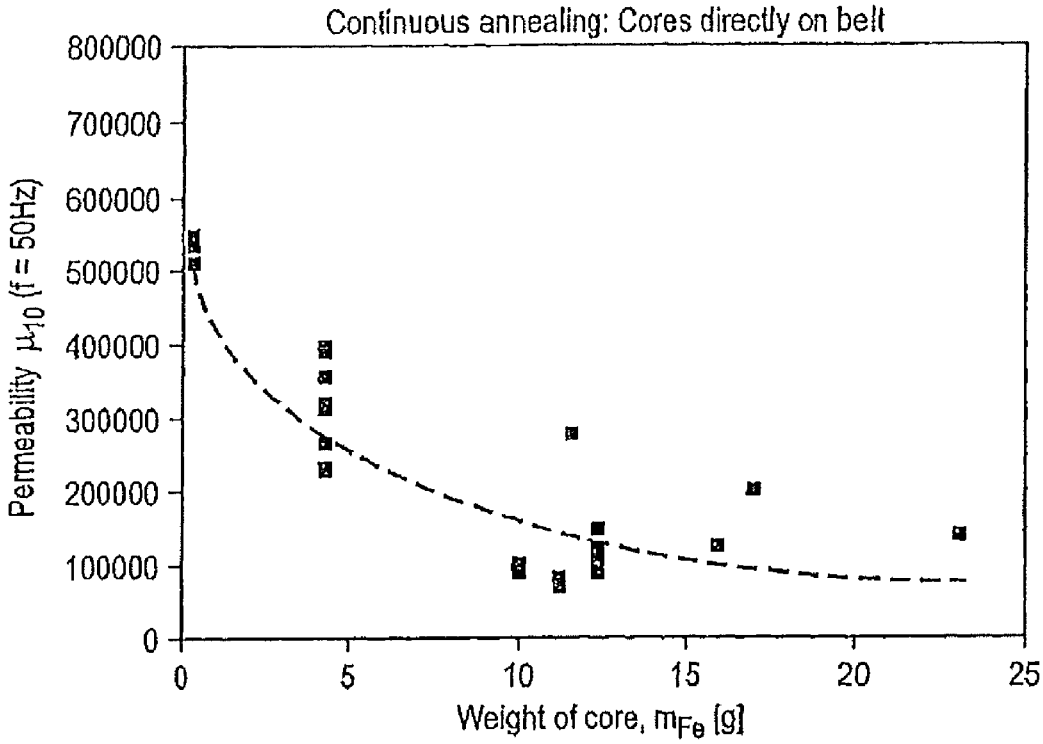
FIG. 2 is a graph showing the effect of the weight of an annular strip wound core on the permeability (at a frequency of 50 Hz) of annular strip-wound cores that are continuously annealed without the presence of a heat sink.

While the first two factors can be well controlled, the rapid heating rate typical for continuous annealing can itself lead to an exothermic development of heat for individual magnet cores, said exothermic development of heat having, according to FIG. 2, a negative effect on the magnetic properties increasing with core weight. FIG. 2 shows the effect of the weight of the magnet core ($\mu_{10} \approx \mu_{max}$) if the magnet cores are heat-treated directly in passing without a heat sink.

Figure 3:
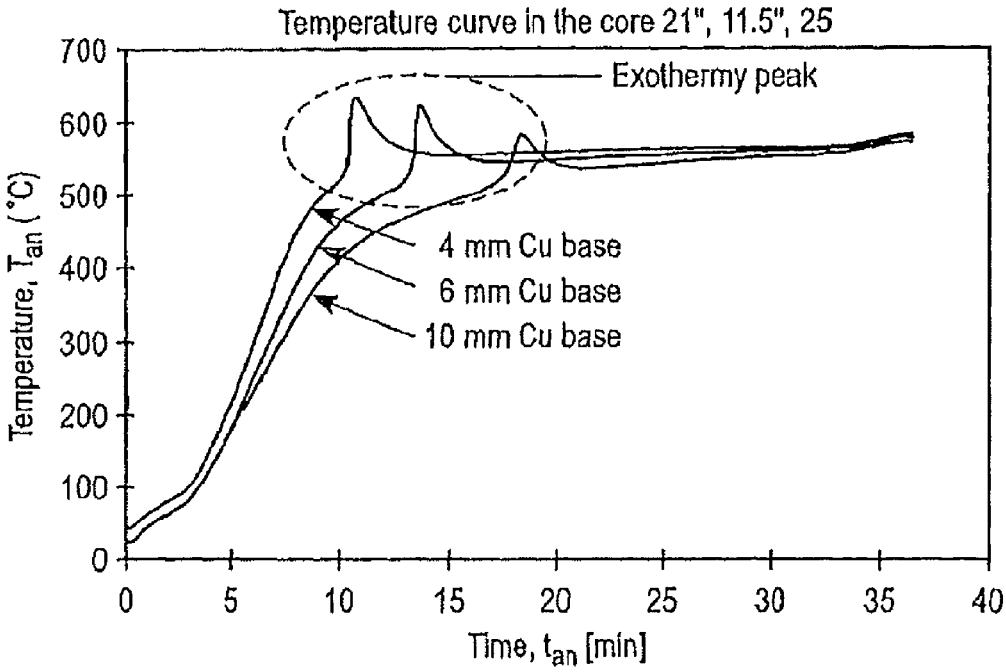
FIG. 3 is a time-temperature diagram showing the effect of the presence of heat sinks of varying thicknesses on the exothermic crystallization behavior of continuously annealed strip-wound cores in an embodiment of the process disclosed herein.

Since a delayed heating would lead to an uneconomical multiplication of the length of the passage section, this problem can be solved by the introduction of heat-absorbing bases (heat sinks) made of metals which conduct heat well or by metallic or ceramic powder beds. Copper plates have proven themselves to be particularly suitable since they have a high specific heat capacity and a very good thermal conductivity. Thereby the exothermically generated heat of crystallization can be withdrawn from the magnet cores on the apical side. Moreover, heat sinks of this type reduce the heating rate whereby the exothermic excess temperature can be further limited. This is illustrated by FIG. 3. FIG. 3 shows the effect of copper heat sinks of different thicknesses on the exothermic behavior in annular strip-wound cores which have dimensions of approximately 21×11.5×25 mm.

Since the rate of temperature compensation depends on the temperature difference between the magnet core and heat sink, its heat capacity is to be adapted via the thickness to the mass and the height of the magnet core.

Figure 4:
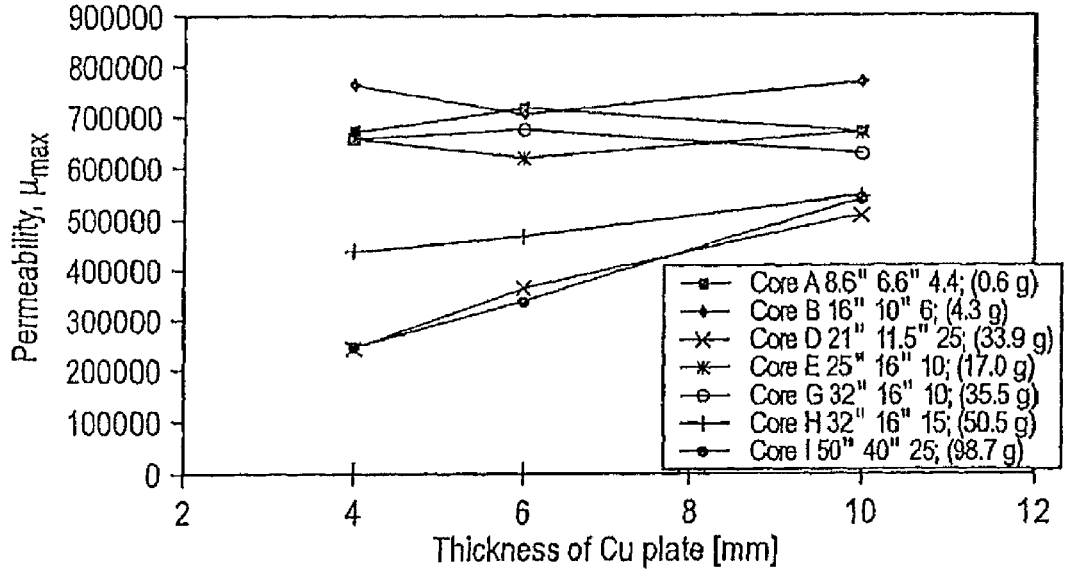
FIG. 4 is a graph showing the effect of heat sinks of various thicknesses on the maximal permeability of continuously annealed annular strip-wound cores of different geometry and different annular strip-wound core mass in an embodiment of the process disclosed herein.

FIG. 4 shows the effect of the thickness of the heat sinks on the maximal permeability of annular strip-wound cores of different geometries or magnet core masses. While according to FIG. 4 for magnet cores with low core weight and/or smaller magnet core height a 4-mm-thick copper heat sink already leads to good magnetic characteristic values, heavier or higher magnet cores need thicker heat sinks with a higher heat capacity. The empirical rule of thumb has developed that the plate thickness d should be $\geqq 0.4\times$ the core height h.

Figure 5:
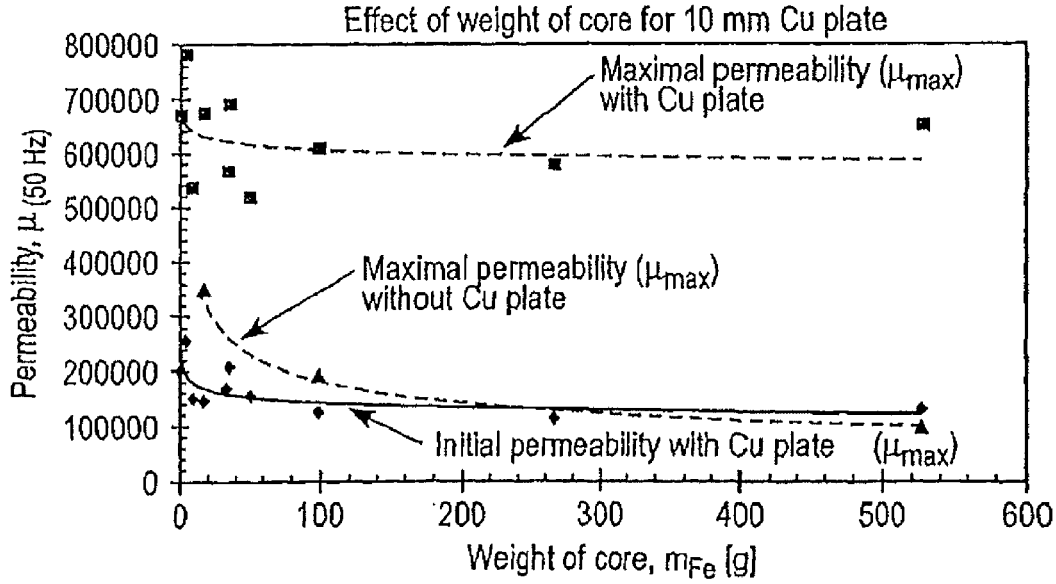
FIG. 5 is a graph showing the effect of the weight of the annular strip-wound core on the permeability (at a frequency of 50 Hz) after continuous annealing on a 10 mm thick copper heat sink in an embodiment of the process disclosed herein.

As follows from FIG. 5, outstanding magnetic characteristic values ($\mu_{max}$(50 Hz)$\geqq$500,000, $\mu_1$>100,000) can be achieved over a wide range of weight taking this rule into account.

Figure 6:
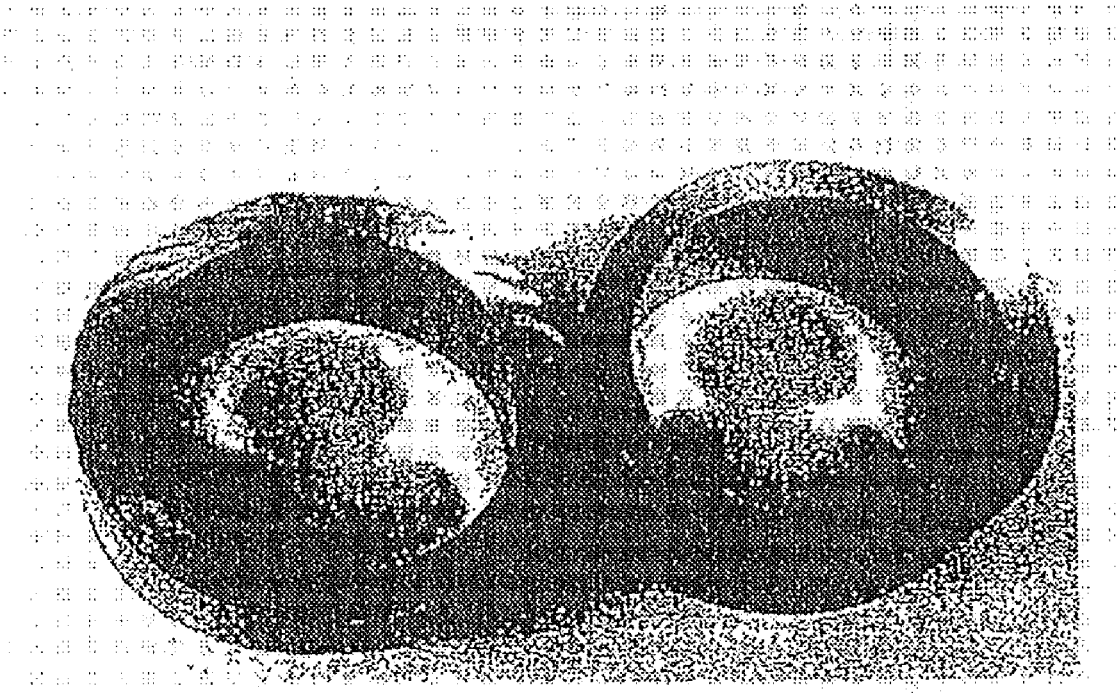
FIG. 6 is photograph showing the apical faces of two annular strip-wound cores after a continuous annealing with and without a heat sink.

The lowering of the magnetic properties in continuous annealing without heat sinks is usually connected with warps and bends in the form of lamellas in the strip seats, which follows from FIG. 6. FIG. 6 shows the apical faces of two annular strip-wound cores with the dimensions 50 mm×40 mm×25 mm after a continuous annealing without a heat sink (left core) and on 10-mm-thick copper heat sink (right core). For the right core practically no warps occurred on the apical side. For the left magnet core on the contrary the maximal permeability was $\mu_{max}$–127,000 where it was on the contrary approximately 620,000 for the right magnet core.

It has been shown that only when more than ca. 85% of the apical face of a core is free of warping can good magnetic characteristic values also be achieved.

Figure 7:
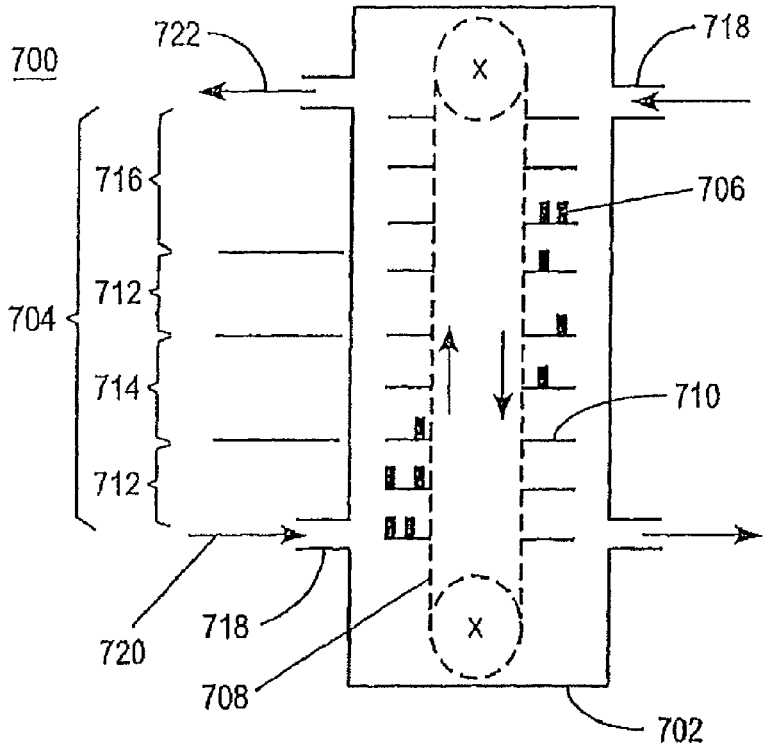
FIG. 7 is a schematic diagram of a tower oven according to an embodiment disclosed herein, and having a vertically running conveyor belt.

FIG. 7 shows schematically a first form of embodiment described herein, a so-called tower oven 700. The tower oven 700 has in this case an oven housing 702 in which the annealing zone 704 runs vertically, e.g., with a reducing or passive protective gas. The unstacked amorphous magnet cores being annealed 706 are in this case conveyed through a vertically running annealing zone 704 by a vertically running conveyor or transport belt 708.

The vertically running conveyor belt 708 has in this case holding surfaces 710, e.g., holding surfaces having thermal ballast or heat absorbing bases, e.g., with latch fastening, standing perpendicular to the surface of the conveyor belt 708. These holding surfaces are desirably made of a material with high heat capacity and/or thermal conductivity, preferably copper. The annular strip-wound magnetic cores 706 in this case desirably lie with their apical faces on the holding surfaces 710. The vertically running annealing zone 704 is in this case subdivided into several heating zones 712, a crystallization zone 714, and a ripening zone 716. The heating zones are provided with separate heating control systems. A reducing or passive protective gas can be introduced through locks 718. The magnetic cores to be annealed can be introduced into the oven at 720 and withdrawn from the oven at 722.

Figure 8:
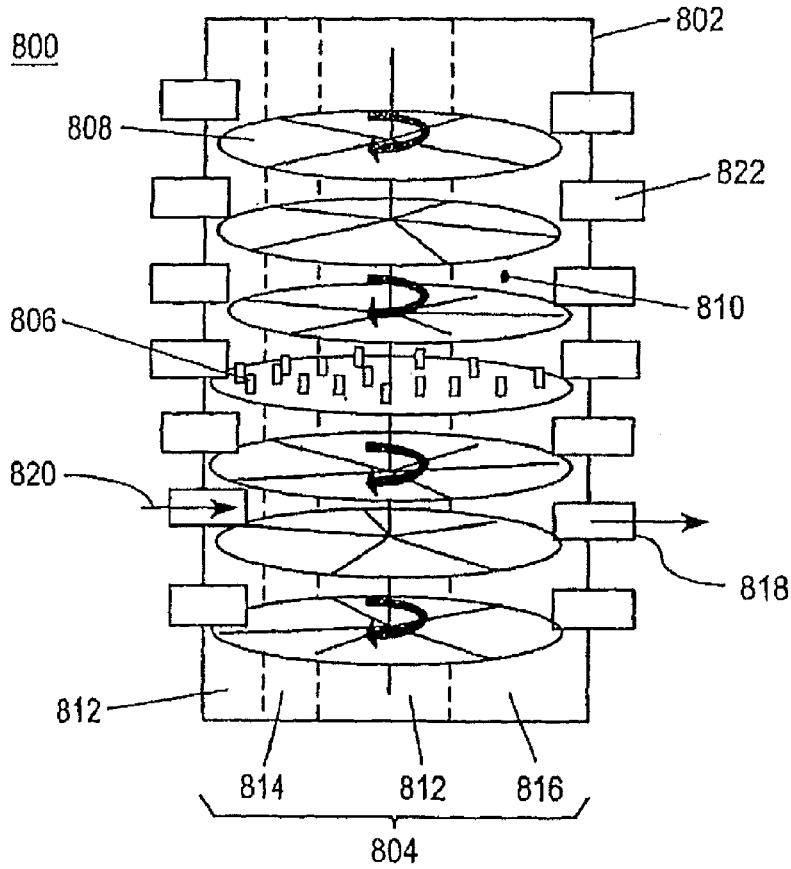
FIG. 8 is a schematic diagram of a multi-stage carousel oven according to an embodiment disclosed herein.

In FIG. 8 an additional form of embodiment described herein is illustrated. Also here the structure of the oven is once again that of a tower oven 800 having an oven housing 802 which encloses an oven space 810, desirably with a reducing or passive protective gas, and in which the annealing zone 804 however runs horizontally. In this case the horizontally running annealing zone 804 is once again subdivided into several separate heating zones 812 which are provided with separate heating control systems, and which include a crystallization zone 814 and a ripening zone 816. As means for the conveyance of unstacked amorphous annular strip-wound cores 806 through the horizontally running annealing zone 804 once again one, but preferably several, holding plates 808 rotating about the axis of the tower oven are provided which serve as heat sinks, thermal ballast, or heat absorbing bases. The unstacked amorphous magnet cores 806 can be introduced to the oven through lock 820 and the annealed magnet cores can be passed through cooling zone and removed through port 818. One or more locks 822 for introducing or removing reducing or passive protective gas can be provided in the oven 800.

The holding plates 808 once again consist entirely or partially of a material with high heat capacity and high thermal conductivity on which the magnet cores 806 lie with their apical faces.

Figure 9:
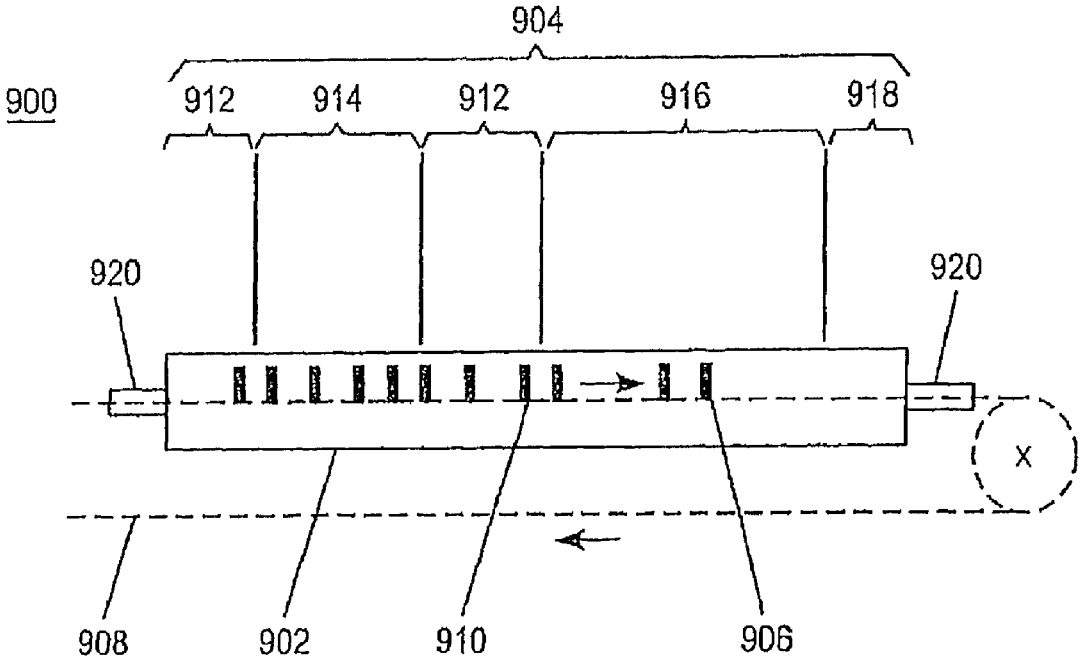
FIG. 9 is a schematic diagram of a horizontal continuous annealing oven according to an embodiment disclosed herein, and having a horizontally running conveyor belt.

FIG. 9 finally shows a third particularly preferred alternative form of embodiment described herein in which the oven housing 902 has the structure of a horizontal continuous annealing oven 900. In this case the annealing zone 904 once again runs horizontally. This form of embodiment is particularly preferred because such an oven can be produced with less effort than the two ovens mentioned above.

In this case the annular strip-wound cores 906 are conveyed through the horizontally running annealing zone 904 (desirably in the presence of a reducing or passive protective gas) via a conveyor belt 908, where the conveyor belt 908 is preferably once again provided with holding plates 910 which serve as heat sinks or thermal ballast or heat absorbing bases. Once again copper plates are particularly preferred here. In an alternative development of the transport, holding plates 910 can be heat sinks which slide on rollers through the oven housing 902.

As follows from FIG. 9, the horizontally running annealing zone 904 is once again subdivided into several separate heating zones 912 which are provided with separate heating control systems, and into a crystallization zone 914, ripening zone 916, and cooling zone 918. Introduction and withdrawal of the magnetic cores 906 can be done through rinsing zones 920 with reducing or passive protective gas.

Figure 10:
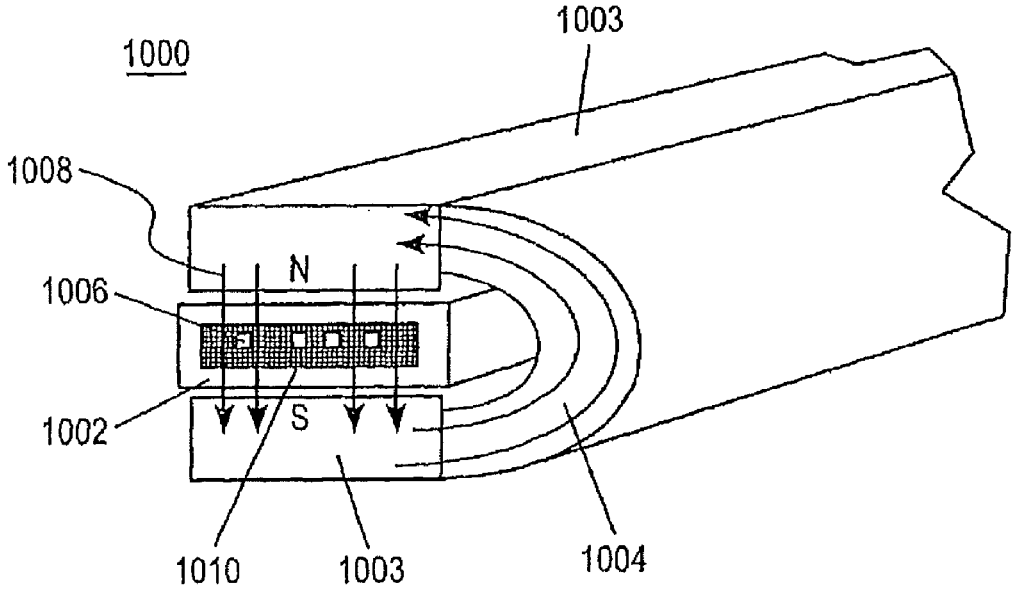
FIG. 10 is a schematic diagram of a transverse field arrangement for a continuous annealing oven, where transverse field generation is by means of a yoke over the oven channel.

In the case of a special form of embodiment of the horizontal continuous annealing oven shown in FIG. 9, the magnetic cross field treatment required for the generation of the flat hysteresis loops can be generated directly in passing. The device 1000 required for this is shown in FIG. 10. For this, at least one part of the heating or passage channel 1002 of the oven is guided between the two pole shoes 1003 of a yoke 1004 so that the passing magnet cores 1006 are energized in the axial direction with a homogeneous magnetic field 1008 whereby a uniaxial anisotropy transverse to the direction of the wound strip is formed in them. The field strength of the yoke 1004 in this case must be so high that the magnet cores 1006 are saturated, at least partially, in the axial direction during the heat treatment. The magnetic cores 1006 may be moved through heating channel 1002 on a holding surface 1010, again having a thermal ballast, heat sink, or heat absorbing base, such as copper.

The greater the percentage of the oven channel over which the yoke is laid, the flatter and more linear the hysteresis loops are in this case.

With these measures the following results were achieved:

For a field strength of 0.3 T, which was effective between the pole shoes of the yoke which [lay] along the entire heating interval, magnet cores with the dimensions 21 mm×11.5 mm×25 mm and the composition $Fe_{ba1}Cu_{1.0}Si_{15.62}B_{6.85}Nb_{2.98}$ were produced which have permeability values of ca. μ=23,000 (f=50 Hz). The remanence was reduced as a consequence of the action of the axial field to 5.6%.

On allocation of only half of the heating interval the uniaxial anisotropy remained weaker and the hysteresis loop was less flat.

In the tempering without magnetic yoke the remanence ratio in comparison thereto was around or above 50% and the permeability curve as a function of the field strength corresponded to that of round hysteresis loops.

With the process according to the invention, and the devices, a new, large-scale, industrial production pathway can be applied by all magnet cores present being crystallized initially in passing. According to whether the required hysteresis loops are supposed to be round, flat, or rectangular, these magnet cores are subsequently either immediately subjected to final processing, i.e. caught in the housing, retempered in a magnetic longitudinal field to form a rectangular hysteresis loop, or retempered in a magnetic cross field to form a flat hysteresis loop and only then subjected to final processing.

Unlike the customary processes the cores can be produced essentially more quickly and in a significantly more economical manner.

The invention having been thus described by reference to certain specific embodiments and drawings, it will be understood that these are illustrative, and not limiting of the appended claims.

The invention claimed is:

1. A process for the production of magnet cores comprising an iron-based soft magnetic alloy wherein at least 50% of the alloy structure is occupied by fine-crystalline particles with an average particle size of 100 nm or less, comprising:

a) preparing an alloy melt;

b) producing an amorphous alloy strip from the alloy melt by means of quick-hardening technology;

c) winding of the amorphous strip to form unstacked amorphous magnet cores;

d) heat treating of the unstacked amorphous magnet cores to form nanocrystalline magnet cores, comprising conveying each unstacked amorphous magnet core through an annealing zone in contact with a heat sink, wherein the heat sink has a high thermal capacity and a high thermal conductivity, and wherein the heat sink comprises a metal, metallic alloy, metal powder, ceramic, or ceramic powder.

2. The process according to claim 1, wherein the heat sinks comprise a metal or a metallic alloy or a metal powder.

3. The process according to claim 2, wherein the metal powder comprises copper, silver, or thermally conductive steel.

4. The process according to claim 1, wherein the heat sinks comprise a ceramic.

5. The process according to claim 1, wherein the heat sinks comprise a ceramic powder.

6. The process according to claim 1, wherein the ceramic comprises magnesium dioxide, aluminum oxide, or aluminum nitride.

7. The process according to claim 1, wherein the heat treating is performed in a temperature range of about 450° C. to about 620° C.

8. The process according to claim 7, wherein the heat treating is performed in a temperature range of 450° C. to about 500° C.

9. The process according to claim 8, wherein the heat treating uses a heating rate of 0.1 K/min to about 20 K/min.

10. The process according to claim 1, wherein the heat sink is in the form of a metal base.

11. The process according to claim 10, wherein the metal base comprises a copper plate.

12. The process according to claim 10, wherein the metal base has a thickness ranging from 4 mm to 10 mm.

13. The process according to claim 10, wherein the metal base has a thickness d, such that $d \geqq 0.4\ h$, wherein h is a height of the unstacked amorphous core.

14. The process according to claim 1, wherein the heat sink comprises a metal powder bed or ceramic powder bed.

* * * * *